US009370212B2

(12) United States Patent
Zhu

(10) Patent No.: US 9,370,212 B2
(45) **Date of Patent: *Jun. 21, 2016**

(54) ARTICLE OF THERMAL PROTECTIVE CLOTHING

(75) Inventor: Reiyao Zhu, Moseley, VA (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 1328 days.

This patent is subject to a terminal disclaimer.

(21) Appl. No.: 13/224,837

(22) Filed: Sep. 2, 2011

(65) Prior Publication Data

US 2013/0055490 A1 Mar. 7, 2013

(51) Int. Cl.

| | |
|---|---|
| ***A41D 31/00*** | (2006.01) |
| ***A41D 13/02*** | (2006.01) |
| ***A41D 1/06*** | (2006.01) |
| ***A41D 1/00*** | (2006.01) |
| ***D03D 13/00*** | (2006.01) |
| ***D03D 15/00*** | (2006.01) |
| ***D03D 15/12*** | (2006.01) |

(52) U.S. Cl.

CPC ..... *A41D 31/0033* (2013.01); *A41D 1/00* (2013.01); *A41D 1/06* (2013.01); *A41D 13/02* (2013.01); *D03D 13/004* (2013.01); *D03D 15/00* (2013.01); *D03D 15/12* (2013.01); *D10B 2201/20* (2013.01); *D10B 2331/021* (2013.01); *D10B 2401/021* (2013.01); *D10B 2401/022* (2013.01); *D10B 2501/04* (2013.01)

(58) Field of Classification Search

CPC ..... A41D 1/00; A41D 1/06; A41D 13/02; A41D 31/022; A41D 31/033

USPC ..... 2/458, 79, 227; 442/208, 209; 428/105, 428/113, 114

See application file for complete search history.

(56) References Cited

U.S. PATENT DOCUMENTS

| | | | | |
|---|---|---|---|---|
| 3,094,511 | A | 6/1963 | Hill, Jr. et al. | |
| 3,193,602 | A | 7/1965 | Leonard et al. | |
| 3,354,127 | A | 11/1967 | Hill, Jr. et al. | |
| 3,673,143 | A | 6/1972 | Bair et al. | |
| 3,748,302 | A | 7/1973 | Jones | |
| 3,803,453 | A | 4/1974 | Hull | |
| 3,819,587 | A | 6/1974 | Kwoleck | |
| 3,869,429 | A | 3/1975 | Blades | |
| 4,172,938 | A | 10/1979 | Mera et al. | |
| 4,612,150 | A | 9/1986 | DeHowitt | |
| 4,668,234 | A | 5/1987 | Vance et al. | |
| 4,755,335 | A | 7/1988 | Ghorashi | |
| 4,883,496 | A | 11/1989 | Ghorashi | |
| 5,096,459 | A | 3/1992 | Ghorashi | |
| 5,208,105 | A | 5/1993 | Ichibori et al. | |
| 5,506,042 | A | 4/1996 | Ichibori et al. | |
| 7,348,059 | B2 * | 3/2008 | Zhu et al. | 428/395 |
| 8,026,189 | B1 * | 9/2011 | Pryne | D03D 11/00 139/408 |
| 8,528,120 | B2 * | 9/2013 | Underwood et al. | 2/458 |
| 8,732,863 | B2 * | 5/2014 | Hines et al. | 2/81 |
| 2004/0001978 | A1 * | 1/2004 | Bader | A41D 31/0022 428/32.68 |
| 2004/0142617 | A1 | 7/2004 | Bottger et al. | |
| 2006/0084337 | A1 * | 4/2006 | Corner | A41D 31/0022 442/203 |
| 2008/0038973 | A1 * | 2/2008 | Sasser | D03D 15/12 442/181 |
| 2008/0057807 | A1 * | 3/2008 | Tutterow et al. | 442/1 |
| 2012/0090080 | A1 * | 4/2012 | Stanhope | D02G 3/443 2/458 |
| 2013/0216810 | A1 * | 8/2013 | Hines et al. | 428/219 |

FOREIGN PATENT DOCUMENTS

| | | |
|---|---|---|
| GB | 2 416 781 | 2/2006 |
| JP | 2011/038224 | 2/2011 |
| WO | WO 2011/137213 A2 | 11/2011 |
| WO | WO 2011/137213 A3 | 11/2011 |

OTHER PUBLICATIONS

Man-Made Fibers; Science and Technology, vol. 2, ; Section titled Fiber-Forming Aromatic Polyamides, p. 297, W. Black et al., Interscience Publishers, 1968.

* cited by examiner

*Primary Examiner* — Arti Singh-Pandey

(57) ABSTRACT

This invention relates to an article of thermal protective clothing having fabric woven with a warp-faced or weft-faced twill weave that incorporates a first yarn forming the majority of the outer article surface that includes hydrophilic fiber and a first flame resistant fiber, with at least 25 weight percent of that first yarn being hydrophilic fiber; and a second yarn forming the majority of the inner article surface that includes at least 80 weight percent of a second flame resistant fiber that is hydrophobic. Alternatively, the first yarn forming the majority of the outer article surface can include a hydrophilic first flame resistant fiber.

15 Claims, No Drawings

ARTICLE OF THERMAL PROTECTIVE CLOTHING

BACKGROUND OF THE INVENTION

1. Field of the Invention

This invention relates to the construction of articles of thermal protective clothing, including garments, which are capable of providing improved comfort under hot or humid environments (i.e. environments where the wearer heavily sweats), due to the composition and construction of the fabric and the arrangement of the fabric in the article.

2. Description of Related Art

The fabrics that that provide the best protection in thermal protective articles tend to use fibers that perform well in thermal events, such as aramid fiber. Unfortunately, many such fibers have a lower moisture regain and therefore can be relatively uncomfortable in some environments. Apparel designed to protect an individual from a high temperature thermal event is of use only if it is worn by the individual in the hazardous environment. If the apparel is uncomfortable, especially in hot and humid environments where the wearer tends to sweat heavily, an individual is more likely to forego the protective apparel, risking injury. Therefore any improvement in the comfort of thermal protective garments is welcomed.

SUMMARY OF THE INVENTION

This invention relates to an article of thermal protective clothing comprising woven fabric having a warp yarn dissimilar to a fill yarn, the fabric forming an inner and outer surface of the article; the fabric further having a warp-faced or weft-faced twill weave, wherein either a) a majority of the outer surface of the article is a first yarn that is a warp yarn in the fabric and a majority of the inner surface of the article is a second yarn that is a fill yarn in the fabric, or b) a majority of the outer surface of the article is a first yarn that is a fill yarn in the fabric and a majority of the inner surface of the article is a second yarn that is a warp yarn in the fabric. The first yarn forming the majority of the outer article surface comprises hydrophilic fiber and a first flame resistant fiber, with at least 25 weight percent of the yarn being hydrophilic fiber. The second yarn forming the majority of the inner article surface comprises at least 80 weight percent of a second flame resistant fiber that is hydrophobic.

DETAILED DESCRIPTION OF THE INVENTION

This invention relates to an article of thermal protective clothing comprising woven fabric with a warp-faced or weft-faced twill weave that incorporates a first yarn forming the majority of the outer article surface that comprises hydrophilic fiber and a first flame resistant fiber, with at least 25 weight percent of that first yarn being hydrophilic fiber; and a second yarn forming the majority of the inner article surface that comprises at least 80 weight percent of a second flame resistant fiber that is hydrophobic. It has been found that the wetting time, or the time it takes for a drop of water to enter the fabric surface, is surprisingly longer for the face or outer surface of the fabric, which has the higher percentage of exposed hydrophilic fiber in the warp- or weft-faced weave; and that the wetting time is surprisingly shorter for the body or inner surface of the fabric, which has a higher percentage of exposed hydrophobic fiber. It is believed that the two-sided structure of the single-layer fabric helps draw the water from the inner to the outer surface, where there is a higher amount of hydrophilic fiber present. In some embodiments, the fabric and the article comprising the fabric has a wetting time on the inner surface of less than 6 seconds, while the wetting time of the outer surface is at least 6 seconds or greater.

This invention relates to an article of thermal protective clothing comprising woven fabric having a warp-faced or weft-faced twill weave. In a twill weave, each weft or filling yarn floats across the warp yarns in a progression of interlacings to the right or left, forming a distinct diagonal line. This diagonal line is also known as a wale. A float is the portion of a yarn that crosses over two or more yarns from the opposite direction. A twill weave requires three or more harnesses, depending on its complexity. Twill weave is often designated as a fraction—such as 2/1—in which the numerator indicates the number of harnesses that are raised (and, thus, threads crossed), in this example, two, and the denominator indicates the number of harnesses that are lowered when a filling yarn is inserted, in this example one. The fraction 2/1 would be read as "two up, one down." The minimum number of harnesses needed to produce a twill weave can be determined by totaling the numbers in the fraction. For the example described, the number of harnesses is three. (The fraction for plain weave is 1/1.)

By warp-faced twill weave, it is meant that the quantity of warp yarns is more on the face of the fabric, for example a 2/1 or 3/1 twill. By weft-faced twill weave it is meant the quantity of weft is more on the face of the fabric, for example a 1/2 or 1/3 twill.

The fabric woven with a warp-faced or weft-faced twill weave has warp yarn that is dissimilar to the fill or weft yarn. In a preferred embodiment, the woven fabric has only one type of warp yarn and only one type of fill or weft yarn and the fabric is a single layer fabric.

The fabric forms the inner and outer surface of the article, and because the fabric has a warp-faced or weft-faced twill weave, a majority of the outer surface of the article is a first yarn that is the warp yarn in the fabric and a majority of the inner surface of the article is a second yarn that is the weft or fill yarn in the fabric; or alternatively, a majority of the outer surface of the article is a first yarn that is the weft or fill yarn in the fabric and a majority of the inner surface of the article is a second yarn that is the warp yarn in the fabric.

In a first embodiment, the first yarn forming the majority of the outer surface of the article comprises at least two types of fibers, which include hydrophilic fiber and a first flame resistant fiber, and at least 25 weight percent of the yarn is the hydrophilic fiber. In some embodiments, the hydrophilic fiber is cellulosic fiber, wool fiber, or mixtures thereof. The cellulosic fiber can be rayon fiber, viscose fiber, cotton fiber, lyocell fiber, or mixtures thereof. If desired, the cellulosic fiber can be provided with a flame retardant as long as the fiber remains hydrophilic.

As used herein, a hydrophilic fiber is one that has a moisture regain of 6 weight percent or higher when measured per test method ASTM D2654-89a Test Methods for Moisture in Textiles. Further, as used herein, moisture regain is the percentage of moisture a bone-dry fiber will absorb from the air at standard temperature and relative humidity, that is, 20 degrees Celsius (+/−1 degree) and 65 percent relative humidity+/−2 percent)

The first yarn forming the majority of the outer surface of the article further comprises a first flame resistant fiber. In some embodiments, this fiber is modacrylic fiber, aramid fiber, polyarenazole fiber, polysulfone fiber, or mixtures thereof. The aramid fiber can be para-aramid fiber, meta-aramid fiber, or mixtures thereof. The polyarenazole fiber can be polybibenzazole fiber, also known commercially as PBI fiber.

In a second embodiment, the first yarn forming the majority of the outer surface of the article comprises at least 25 percent by weight a hydrophilic first flame resistant fiber. Preferably, this hydrophilic first flame resistant fiber is made from an inherently flame-resistant polymer, and the fiber has a moisture regain of 6 weight percent or higher when measured per test method ASTM D2654-89a Test Methods for Moisture in Textiles. In some embodiments, this flame resistant fiber is made from polyoxadiazole polymer. In some embodiments the first yarn is made solely of this hydrophilic first flame resistant fiber. If abrasion resistance is desired, up to 20 percent by weight (generally 5 to 20 percent by weight) of nylon or other abrasion-resistant thermoplastic fiber may be included in the yarn.

The second yarn that forms the majority of the inner surface of the article comprises at least 80 weight percent of a second flame resistant fiber that is hydrophobic. As used herein, a hydrophobic fiber is one that has a moisture regain of less than 6 weight percent when measured per test method ASTM D2654-89a Test Methods for Moisture in Textiles. In some embodiments, this fiber is modacrylic fiber, aramid fiber, polyarenazole fiber, polysulfone fiber, or mixtures thereof. The aramid fiber can be para-aramid fiber, meta-aramid fiber, or mixtures thereof. In some preferred embodiments, the second yarn is 100% meta-aramid fiber.

The above weight percentages of fibers in the yarns are on a basis of the previously named components, that is, the total weight of these named components in the yarn. By "yarn" is meant an assemblage of fibers spun or twisted together to form a continuous strand that can be used in weaving, knitting, braiding, or plaiting, or otherwise made into a textile material or fabric. In some preferred embodiments, the fibers are staple fibers.

In some preferred embodiments, the first and second flame resistant fibers are different. However, in some other embodiments, the first and second flame resistant fibers can be the same fiber.

In some embodiments, either one or both of the first or second yarns further a blend of modacrylic and cellulosic fiber. In some embodiments, either one or both of the first or second yarns comprise a blend of FR rayon and aramid fiber.

In some embodiments, the article contains a warp- or weft-faced woven fabric wherein the first yarn forming the majority of the outer surface comprises 25 to 50 weight percent lyocell fiber, 35 to 70 weight percent modacrylic fiber, and 5 to 15 weight percent para-aramid fiber and the second yarn forming the majority of the inner surface comprises 100% meta-aramid fiber. In some preferred embodiments, the article contains a warp- or weft-faced woven fabric wherein the first yarn forming the majority of the outer surface comprises 35 to 45 weight percent lyocell fiber, 40 to 60 weight percent modacrylic fiber, and 5 to 15 weight percent para-aramid fiber and the second yarn forming the majority of the inner surface comprises 100% meta-aramid fiber.

In some embodiments, the article contains a warp- or weft-faced woven fabric wherein the first yarn forming the majority of the outer surface comprises 40 to 60 weight percent FR rayon fiber, 20 to 40 weight percent meta-aramid fiber, and up to 20 weight percent nylon fiber and the second yarn forming the majority of the inner surface comprises 100% meta-aramid fiber. In some preferred embodiments, the article contains a warp- or weft-faced woven fabric wherein the first yarn forming the majority of the outer surface comprises 45 to 55 weight percent FR rayon fiber, 25 to 35 weight percent meta-aramid fiber, and up to 20 weight percent nylon fiber and the second yarn forming the majority of the inner surface comprises 100% meta-aramid fiber.

In some other embodiments, the article contains a warp- or weft-faced woven fabric wherein the first yarn forming the majority of the outer surface comprises 100 weight percent hydrophilic polyoxadiazole fiber and the second yarn forming the majority of the inner surface comprises 100% meta-aramid fiber. In some other embodiments, the article contains a warp- or weft-faced woven fabric wherein the first yarn forming the majority of the outer surface comprises 80 to 95 weight percent hydrophilic polyoxadiazole fiber and 5 to 20 weight percent nylon fiber, and the second yarn forming the majority of the inner surface comprises 100% meta-aramid fiber.

As used herein, "aramid" is meant a polyamide wherein at least 85% of the amide (—CONH—) linkages are attached directly to two aromatic rings. Additives can be used with the aramid and, in fact, it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511. Meta-aramid are those aramids where the amide linkages are in the meta-position relative to each other, and para-aramids are those aramids where the amide linkages are in the para-position relative to each other. The aramids most often used are poly(metaphenylene isophthalamide) and poly(paraphenylene terephthalamide).

When used in yarns, the meta-aramid fiber provides a flame resistant char forming fiber with an Limiting Oxygen Index (LOI) of about 26. Meta-aramid fiber is also resistant to the spread of damage to the yarn due to exposure to flame. Because of its balance of modulus and elongation physical properties, meta-aramid fiber also provides for a comfortable fabric useful in single-layer fabric garments meant to be worn as industrial apparel in the form of conventional shirts, pants, and coveralls.

By flame-retardant rayon fiber, it is meant a rayon fiber having one or more flame retardants and having a fiber tensile strength of at least 2 grams per denier. Cellulosic or rayon fibers containing as the flame retardant a silicon dioxide in the form of polysilicic acid are specifically excluded because such fibers have a low fiber tensile strength. Also, while such fibers are good char formers, in relative terms their vertical flame performance is worse that fibers containing phosphorous compounds or other flame retardants.

Rayon fiber is well known in the art, and is a manufactured fiber generally composed of regenerated cellulose, as well has regenerated cellulose in which substituents have replaced not more than 15% of the hydrogens of the hydroxyl groups. They include yarns made by the viscose process, the cuprammonium process, and the now obsolete nitrocellulose and saponified acetate processes; however in a preferred embodiment the viscose process is used. Generally, rayon is obtained from wood pulp, cotton linters, or other vegetable matter dissolved in a viscose spinning solution. The solution is extruded into an acid-salt coagulating bath and drawn into continuous filaments. Groups of these filaments may be formed into yarns or cut into staple and further processed into spun staple yarns. As used herein, rayon fiber includes what is known as lyocell fiber.

Flame retardants can be incorporated into the rayon fiber by adding flame retardant chemicals into the spin solution and spinning the flame retardant into the rayon fiber, coating the rayon fiber with the flame retardant, contacting the rayon fiber with the flame retardant and allowing the fiber to absorb the flame retardant, or any other process that incorporates a flame retardant into or with a rayon fiber. Generally speaking, rayon fibers that contain one or more flame retardants are given the designation "FR," for flame retardant. In a preferred embodiment, the FR rayon has spun-in flame retardants.

The FR rayon has a high moisture regain, which is believed to provide a comfort component to fabrics. The FR rayon fiber can contain one or more of a variety of commercially available flame retardants; including for example certain phosphorus compounds like Sandolast 9000® available from Sandoz, and the like. While various compounds can be used as flame retardants, in a preferred embodiment, the flame retardant is based on a phosphorus compound. A useful FR rayon fiber is available from Daiwabo Rayon Co., Ltd., of Japan under the name DFG "Flame-resistant viscose rayon". Another useful FR rayon fiber is available from Lenzing AG under the name of Viscose FR (also known as Lenzing FR® available from Lenzing Fibers of Austria).

By modacrylic fiber it is meant acrylic synthetic fiber made from a polymer comprising primarily acrylonitrile. Preferably the polymer is a copolymer comprising 30 to 70 weight percent of a acrylonitrile and 70 to 30 weight percent of a halogen-containing vinyl monomer. The halogen-containing vinyl monomer is at least one monomer selected, for example, from vinyl chloride, vinylidene chloride, vinyl bromide, vinylidene bromide, etc. Examples of copolymerizable vinyl monomers are acrylic acid, methacrylic acid, salts or esters of such acids, acrylamide, methylacrylamide, vinyl acetate, etc.

The preferred modacrylic fibers are copolymers of acrylonitrile combined with vinylidene chloride, the copolymer having in addition an antimony oxide or antimony oxides for improved fire retardancy. Such useful modacrylic fibers include, but are not limited to, fibers disclosed in U.S. Pat. No. 3,193,602 having 2 weight percent antimony trioxide, fibers disclosed in U.S. Pat. No. 3,748,302 made with various antimony oxides that are present in an amount of at least 2 weight percent and preferably not greater than 8 weight percent, and fibers disclosed in U.S. Pat. Nos. 5,208,105 & 5,506,042 having 8 to 40 weight percent of an antimony compound.

Within the yarns, modacrylic fiber provides a flame resistant char forming fiber with an LOI typically at least 28 depending on the level of doping with antimony derivatives. Modacrylic fiber is also resistant to the spread of damage to the yarn due to exposure to flame. Modacrylic fiber while highly flame resistant does not by itself provide adequate tensile strength to a yarn, or fabric made from the yarn, to offer the desired level of break-open resistance when exposed to an electrical arc. It also does not provide, by itself, adequate char performance according to NFPA 2112 or ASTM F1506 requirement per testing method of ASTM D6413.

When used in the yarns, the addition of nylon fiber provides improved abrasion resistance to the fabrics. Nylons are long chain synthetic polyamides having recurring amide groups (—NH—CO—) as an integral part of the polymer chain, and two common examples of nylons are nylon 66, which is polyhexamethylenediamine adipamide, and nylon 6, which is polycaprolactam. Other nylons can include nylon 11, which is made from 11-amino-undecanoic acid; and nylon 610, which is made from the condensation product of hexamethylenediamine and sebacic acid. In some preferred embodiments the nylon is nylon 610, nylon 6, nylon 66 or mixtures thereof.

When meta-aramid fiber is used, in some embodiments it is desirable to use a fiber that has a degree of crystallinity in a range of about 20 to 50 percent. Meta-aramid fiber provides additional tensile strength to the yarn and fabrics formed from the yarn. Modacrylic and meta-aramid fiber combinations are highly flame resistant but do not provide adequate tensile strength to a yarn or fabric made from the yarn to offer the desired level of break-open resistance when exposed to an electrical arc. In some embodiments, the degree of crystallinity of the meta-aramid fiber is at least 20% and more preferably at least 25%. For purposes of illustration due to ease of formation of the final fiber a practical upper limit of crystallinity is 50% (although higher percentages are considered suitable). Generally, the crystallinity will be in a range from 25 to 40%. An example of a commercial meta-aramid fiber having this degree of crystallinity is Nomex® T 450 available from E. I. du Pont de Nemours & Company of Wilimington, Del. The degree of crystallinity of an meta-aramid fiber is determined by one of two methods. The first method is employed with a non-voided fiber while the second is on a fiber that is not totally free of voids.

The percent crystallinity of meta-aramids in the first method is determined by first generating a linear calibration curve for crystallinity using good, essentially non-voided samples. For such non-voided samples the specific volume (1/density) can be directly related to crystallinity using a two-phase model. The density of the sample is measured in a density gradient column. A meta-aramid film, determined to be non-crystalline by x-ray scattering methods, was measured and found to have an average density of 1.3356 g/cm$^3$. The density of a completely crystalline meta-aramid sample was then determined from the dimensions of the x-ray unit cell to be 1.4699 g/cm$^3$. Once these 0% and 100% crystallinity end points are established, the crystallinity of any non-voided experimental sample for which the density is known can be determined from this linear relationship:

$$\text{Crystallinity} = \frac{(1/\text{non-crystalline density}) - (1/\text{experimental density})}{(1/\text{non-crystalline density}) - (1/\text{fully-crystalline density})}$$

Since many fiber samples are not totally free of voids, Raman spectroscopy is the preferred method to determine crystallinity. Since the Raman measurement is not sensitive to void content, the relative intensity of the carbonyl stretch at 1650$^{-1}$ cm can be used to determine the crystallinity of a meta-aramid in any form, whether voided or not. To accomplish this, a linear relationship between crystallinity and the intensity of the carbonyl stretch at 1650 cm$^{-1}$, normalized to the intensity of the ring stretching mode at 1002 cm$^{-1}$, was developed using minimally voided samples whose crystallinity was previously determined and known from density measurements as described above. The following empirical relationship, which is dependent on the density calibration curve, was developed for percent crystallinity using a Nicolet Model 910 FT-Raman Spectrometer:

$$\%\ \text{crystallinity} = 100.0 \times \frac{(I(1650\ \text{cm}^{-1}) - 0.2601)}{0.1247}$$

where I(1650 $cm^{-1}$) is the Raman intensity of the meta-aramid sample at that point. Using this intensity the percent crystallinity of the experiment sample is calculated from the equation.

Meta-aramid fibers, when spun from solution, quenched, and dried using temperatures below the glass transition temperature, without additional heat or chemical treatment, develop only minor levels of crystallinity. Such fibers have a percent crystallinity of less than 15 percent when the crystallinity of the fiber is measured using Raman scattering techniques. These fibers with a low degree of crystallinity are considered amorphous meta-aramid fibers that can be crystallized through the use of heat or chemical means. The level of crystallinity can be increased by heat treatment at or above the glass transition temperature of the polymer. Such heat is typically applied by contacting the fiber with heated rolls under tension for a time sufficient to impart the desired amount of crystallinity to the fiber.

The level of crystallinity of m-aramid fibers can be increased by a chemical treatment, and in some embodiments this includes methods that color, dye, or mock dye the fibers prior to being incorporated into a fabric. Some methods are disclosed in, for example, U.S. Pat. Nos. 4,668,234; 4,755,335; 4,883,496; and 5,096,459. A dye assist agent, also known as a dye carrier may be used to help increase dye pick up of the aramid fibers. Useful dye carriers include aryl ether, benzyl alcohol, acetophenone, and mixtures thereof. The addition of para-aramid fibers in the yarn can provide fabrics formed from the yarn some additional resistance to shrinkage and break-open after flame exposure. Larger amounts of para-aramid fibers in the yarns can make garments comprising the yarns uncomfortable to the wearer. The yarn has 5 to 20 weight percent para-aramid fibers, and in some embodiments, the yarn has 5 to 15 weight percent para-aramid fibers.

Because static electrical discharges can be hazardous for workers working with sensitive electrical equipment or near flammable vapors, the first or second yarn optionally contains an antistatic component. Illustrative examples are steel fiber, carbon fiber, or a carbon combined with an existing fiber. If added to the yarn, the antistatic component is present in an amount of 1 to 3 weight percent of the total yarn, replacing a similar amount of the first or second flame resistant fiber.

U.S. Pat. No. 4,612,150 (to De Howitt) and U.S. Pat. No. 3,803,453 (to Hull) describe an especially useful conductive fiber wherein carbon black is dispersed within a thermoplastic fiber, providing anti-static conductance to the fiber. The preferred antistatic fiber is a carbon-core nylon-sheath fiber. Use of anti-static fibers provides yarns, fabrics, and garments having reduced static propensity, and therefore, reduced apparent electrical field strength and nuisance static. Staple yarns can be produced by yarn spinning techniques such as but not limited to ring spinning, core spinning, and air jet spinning, including air spinning techniques such as Murata air jet spinning where air is used to twist staple fibers into a yarn, provided the required degree of crystallinity is present in the final yarn. If single yarns are produced, they are then preferably plied together to form a ply-twisted yarn comprising at least two single yarns prior to being converted into a fabric.

In some preferred embodiments, the fabric has a char length according to ASTM D-6413-99 of less than 4 inches. Char length is a measure of the flame resistance of a textile. A char is defined as a carbonaceous residue formed as the result of pyrolysis or incomplete combustion. The char length of a fabric under the conditions of test of ASTM 6413-99 is defined as the distance from the fabric edge that is directly exposed to the flame to the furthest point of visible fabric damage after a specified tearing force has been applied.

In some preferred embodiments the fabrics have an arc resistance, normalized for basis weight, of at least 1.2 calories per square centimeter per ounce per square yard (0.148 Joules per square centimeter per grams per square meter).

The article of thermal protective clothing comprising a woven fabric having a warp-faced or weft-faced twill weave can be in the form of a coverall, shirt, or pants made essentially from a single layer of the warp-faced or weft-faced twill weave fabric having a basis weight in the range of 135 to 407 grams per square meter (4 to 12 ounces per square yard). Exemplary garments of this type include jumpsuits and coveralls for fire fighters or for military personnel. Such suits are typically used over the firefighters clothing and can be used to parachute into an area to fight a forest fire. Other garments can include pants, shirts, gloves, sleeves and the like that can be worn in situations such as chemical processing industries or industrial electrical/utility where an extreme thermal event might occur.

The performance of a fabric or garment in a flash fire can be measured using an instrumented mannequin using the test protocol of ASTM F1930. The mannequin is clothed in the material to be measured, and then exposed to flames from burners; temperature sensors distributed throughout the mannequin measure the local temperature experienced by the mannequin that would be the temperatures experienced by a human body if subjected to the same amount of flames. Given a standard flame intensity, the extent of the burns that would be experienced by a human, (i.e., second degree, third degree, etc.) and the percent of the body burned can be determined from the mannequin temperature data. A low predicted body burn is an indication of better protection of the garment in an actual fire hazard.

The minimum performance required for flash fire protective apparel, per the NFPA 2112 standard, is less than 50% body burn from a 3 second flame exposure. Since flash fire is a very real threat to workers in some industries, and it is not possible to fully anticipate how long the individual will be engulfed in flames, any improvement in the flash fire performance of protective apparel fabrics and garments has the potential to save lives. In particular, if the protective apparel can provide enhanced protection to fire exposure above 3 seconds, e.g. 4 seconds or more, this means the wearer has additional time for escaping the hazard with certain protection. Flash fires represent one of the most extreme types of thermal threat a worker can experience; such threats are much more severe than the simple exposure to a flame.

At a fabric weight of less than 6.5 ounces per square yard, garments made from fabrics as previously described are believed to provide thermal protection to the wearer that is equivalent to less than a 70 percent predicted body burn when exposed to 4 second flame exposure per ASTM F1930 while maintaining a Category 2 arc rating per ASTM F1959 and NFPA 70E. This is a significant improvement over the minimum standard of less than a 50 percent predicted body burn to the wearer at a 3 second exposure; burn injury is essentially exponential in nature with respect to flame exposure for some other flame resistance fabrics. The protection provided by the garment, should there be an additional second of flame exposure time, can potentially mean the difference between life and death.

There are two common category rating systems for arc ratings. The National Fire Protection Association (NFPA 70E) has 4 different categories with Category 1 having the lowest arc hazard and Category 4 having the highest hazard. Under the NFPA 70E system, Categories 1, 2, 3, and 4 correspond to the arc protection value of a fabric of 4, 8, 25, and 40 calories per square centimeter, respectively. The National Electric Safety Code (NESC) also has a rating system with 3 different categories with Category 1 being the lowest hazard and Category 3 being the highest hazard. Under the NESC system, Categories 1, 2, and 3 correspond to the arc protection value of a fabric of 4, 8, and 12 calories per square centimeter, respectively. Therefore, a fabric or garment having arc rating of 8 calories per square centimeter can withstand a Category 2 hazard, as measured per standard set method ASTM F1959.

In some preferred embodiments the garment is made from a fabric having an arc resistance, normalized for basis weight, of at least 1.2 calories per square centimeter per ounce per square yard (0.148 Joules per square centimeter per grams per square meter).

Test Methods

The moisture regain of yarns, fabrics, and garments was determined in accordance with ASTM Test Method D2654-89.

The arc resistance of fabrics is determined in accordance with ASTM F-1959-99 "Standard Test Method for Determining the Arc Thermal Performance Value of Materials for Clothing".

The limited oxygen index (LOI) of fabrics is determined in accordance with ASTM G-125-00 "Standard Test Method for Measuring Liquid and Solid Material Fire Limits in Gaseous Oxidants". The minimum concentration of oxygen, expressed as a volume percent, in a mixture of oxygen and nitrogen that will just support flaming combustion of a fabrics initially at room temperature is determined under the conditions of ASTM G125/D2863.

The thermal protection performance of fabrics is determined in accordance with NFPA 2112 "Standard on Flame Resistant Garments for Protection of Industrial Personnel Against Flash Fire". The term thermal protective performance (or TPP) relates to a fabric's ability to provide continuous and reliable protection to a wearer's skin beneath a fabric when the fabric is exposed to a direct flame or radiant heat.

Flash fire protection level testing was done according to ASTM F-1930 using an instrumented thermal mannequin with standard pattern coverall made with the test fabric.

The char length of fabrics is determined in accordance with ASTM D-6413-99 "Standard Test Method for Flame Resistance of Textiles (Vertical Method)".

The wetting time of each side or surface of the fabric was determined in accordance with test method AATCC 79-2007. In this test method, a drop of water is allowed to fall from a fixed height onto the taut surface of the test specimen. The time required for the specular reflection of the water drop to disappear is then measured and recorded as the wetting time.

Example 1

This example illustrates fabric having an outer surface and an inner surface, wherein the outer surface is more hydrophilic than the inner surface. A durable arc and thermal protective fabric was prepared having different warp and fill airjet spun yarns.

The warp yarn was made from an intimate staple fiber blend of 50 weight percent modacrylic fiber, 40 weight percent lyocell fiber, and 10 weight percent para-aramid fiber. The modacrylic fiber was a ACN/polyvinylidene chloride copolymer fiber having 6.8% antimony and known commercially as Protex®C available from Kaneka Corporation. The lyocell fiber was regenerated cellulose fiber known commercially as Tencel® fiber available from Lenzing. The para-aramid fiber was poly(p-phenylene terephthalamide) (PPD-T) fiber known commercially as Kevlar® 29 fiber available from E. I. du Pont de Nemours and Company. A picker blend sliver of modacrylic fiber, lyocell fiber, and para-aramid fiber was made into a spun staple yarn using cotton system processing and an airjet spinning frame. The resultant yarn was a 19.6 tex (30 cotton count) single yarn. Two single yarns were then plied on a plying machine to make a two-ply yarn having a ply twist of 10 turns/inch twist. This yarn was used as the warp yarn.

The fill yarn was made from an the intimate staple fiber blend of 93 weight percent meta-aramid fiber, 5 weight percent para-aramid fiber, and 2 weight percent antistatic fiber. The meta-aramid fiber was poly(m-phenylene isophthalamide) (MPD-I) fiber known commercially as Nomex® type T455 fiber available from E. I. du Pont de Nemours and Company. The para-aramid fiber was the same PPD-T fiber as used in the warp yarn. The antistatic fiber was a carbon-core nylon-sheath fiber known commercially as P140 available from Invista. A picker blend sliver of meta-aramid fiber, para-aramid fiber, and antistatic fiber was prepared and was made into spun staple yarn using cotton system processing and an airjet spinning frame. The resultant yarn was a 19.6 tex (30 cotton count) single yarn. Two single yarns were then plied on a plying machine to make a two-ply yarn having a ply twist of 10 turns/inch twist. This yarn was used as the fill yarn.

The yarns were then used as in the warp and fill of a fabric that was woven on a shuttle loom in a warp-faced 2×1 twill construction. The greige twill fabric had a basis weight of 170 $g/m^2$ (5.5 $oz/yd^2$). The greige twill fabric was then scoured in hot water and was jet dyed using basic dye and reactive dye and dried. The finished twill fabric had a construction of 31 ends×16 picks per cm (77 ends×47 picks per inch) and a basis weight of 203 $g/m^2$ (6.0 $oz/yd^2$).

This fabric has an arc resistance, normalized for basis weight, of 1.2 calories per square centimeter per ounce per square yard (0.148 Joules per square centimeter per grams per square meter).

The wetting time of each side of this fabric was measured per AATCC 79-2007 and is shown in the Table. These results show that surprisingly, it takes a longer time for a drop of water to disappear from the face or outer surface of the fabric, which has the higher percentage of exposed hydrophilic fiber, and it takes a shorter amount of time for a drop of water to disappear from the body or inner surface of the fabric, which has a higher percentage of hydrophobic fiber exposed. It is believed that the two-sided structure of the single layer fabric helps draw the water to the outer surface, where there is a higher amount of hydrophilic fiber present.

TABLE

| | Fabric Face Side (Outer Surface) | Fabric Body Side (Inner Surface) |
|---|---|---|
| Wetting Time (sec) | 7.29 | 5.29 |

Example 2

Example 1 is repeated with similar results; however, in the warp yarns used in the fabric, the intimate staple fiber blend of 50 weight percent modacrylic fiber, 40 weight percent lyocell fiber, and 10 weight percent para-aramid fiber is replaced by 100 weight percent of a hydrophilic polyoxadiazole staple fiber.

Example 3

Example 2 is repeated with similar results; however, 20 weight percent of the hydrophilic polyoxadiazole fiber used in the warp yarn is replaced with nylon fiber for improved abrasion resistance; in addition, the 5 weight percent para-aramid fiber in the fill yarn is replaced with meta-aramid fiber, making the final composition of the intimate staple fiber blend of the fill yarns to be 98 weight percent meta-aramid fiber and 2 weight percent antistatic fiber.

Example 4

Examples 1 thru 3 are repeated with similar results; however the warp and fill yarns are interchanged and weft-faced fabrics are woven with these yarns.

Example 5

A portion of the fabrics of Examples 1 thru 4 is cut into various shapes and sewn together to convert each of the fabrics into single-layer protective coveralls, shirts, and pants useful for those exposed to thermal hazards.

What is claimed is:

1. An article of thermal protective clothing comprising woven fabric having a warp yarn dissimilar to a fill yarn, the fabric forming an inner and outer surface of the article; the fabric further having a warp-faced or weft-faced twill weave, wherein either:

a) a majority of the outer surface of the article is a first yarn that is the warp yarn in the fabric and a majority of the inner surface of the article is a second yarn that is the fill yarn in the fabric, or b) a majority of the outer surface of the article is a first yarn that is a fill yarn in the fabric and a majority of the inner surface of the article is a second yarn that is the warp yarn in the fabric; and wherein the first yarn forming the majority of the outer surface of the article comprises hydrophilic fiber and a first flame resistant fiber, with at least 25 weight percent of the yarn being hydrophilic fiber; and wherein the second yarn forming the majority of the inner surface of the article comprises at least 80 weight percent of a second flame resistant fiber that is hydrophobic, wherein the wetting time on the inner surface is less than 6 seconds and the wetting time for the outer surface is at least 6 seconds or greater.

2. The article of claim 1 wherein the warp-faced twill weave is a 1/2, 2/1, 1/3 or 3/1 twill weave.

3. The article of claim 1 wherein the hydrophilic fiber is cellulosic fiber, wool fiber, or mixtures thereof.

4. The article of claim 3 wherein the cellulosic fiber is rayon fiber, viscose fiber, cotton fiber, lyocell fiber, or mixtures thereof.

5. The article of claim 4 wherein the cellulosic fiber is provided with a flame retardant.

6. The article of claim 1 wherein the first or second flame resistant fiber is modacrylic fiber, aramid fiber, polyarenazole fiber, polysulfone fiber, or mixtures thereof.

7. The article of claim 1 wherein the either one or both of the first or second yarns comprise a blend of modacrylic and cellulosic fiber.

8. The article of claim 1 wherein the either one or both of the first or second yarns comprise a blend of FR rayon and aramid fiber.

9. The article of claim 1 wherein:

i) the first yarn forming the majority of the outer surface comprises 40% lyocell fiber, 50% modacrylic fiber, and 10% para-aramid fiber; and ii) the second yarn forming the majority of the inner surface comprises 100% meta-aramid fiber.

10. The article of claim 1 wherein:

i) the first yarn forming the majority of the outer surface comprises 50% FR rayon fiber, 30% meta-aramid fiber, and 20% nylon fiber; and ii) the second yarn forming the majority of the inner surface comprises 100% meta-aramid fiber.

11. An article of thermal protective clothing comprising woven fabric having a warp yarn dissimilar to a fill yarn, the fabric forming an inner and outer surface of the article; the fabric further having a warp-faced or weft-faced twill weave, wherein either:

a) a majority of the outer surface of the article is a first yarn that is the warp yarn in the fabric and a majority of the inner surface of the article is a second yarn that is the fill yarn in the fabric, or b) a majority of the outer surface of the article is a first yarn that is a fill yarn in the fabric and a majority of the inner surface of the article is a second yarn that is the warp yarn in the fabric; and wherein the first yarn forming the majority of the outer surface of the article comprises at least 25 percent by weight a hydrophilic first flame resistant fiber; and wherein the second yarn forming the majority of the inner surface of the article comprises at least 80 weight percent of a second flame resistant fiber that is hydrophobic, wherein the wetting time on the inner surface is less than 6 seconds and the wetting time for the outer surface is at least 6 seconds or greater.

12. The article of claim 11, wherein the hydrophilic first flame resistant fiber is polyoxadiazole fiber.

13. The article of claim 11 wherein the first yarn further comprises an abrasion resistant fiber.

14. The article of claim 13 wherein the abrasion resistant fiber is a nylon fiber.

15. A coverall, shirt, or pants article made from a single layer of the warp-faced twill weave fabric, the fabric having a warp yarn dissimilar to a fill yarn, the fabric forming an inner and outer surface of the article; and wherein either:

a) a majority of the outer surface of the article is a first yarn that is the warp yarn in the fabric and a majority of the inner surface of the article is a second yarn that is the fill yarn in the fabric, or b) a majority of the outer surface of the article is a first yarn that is a fill yarn in the fabric and a majority of the inner surface of the article is a second yarn that is the warp yarn in the fabric; and wherein the first yarn forming the majority of the outer surface of the article comprises either:

i) hydrophilic fiber and a first flame resistant fiber, with at least 25 weight percent of the yarn being hydrophilic fiber, or ii) at least 25 percent by weight a hydrophilic first flame resistant fiber; and wherein the second yarn forming the majority of the inner surface of the article comprises at least 80 weight percent of a second flame resistant fiber that is hydrophobic, wherein the wetting time on the inner surface is less than 6 seconds and the wetting time for the outer surface is at least 6 seconds or greater.

* * * * *